US008479933B2

(12) United States Patent
Vaquera

(10) Patent No.: US 8,479,933 B2
(45) Date of Patent: Jul. 9, 2013

(54) REMOVABLE TRUCK-MOUNTED CRANE

(76) Inventor: Moises C. Vaquera, St. George, UT (US)

( * ) Notice: Subject to any disclaimer, the term of this patent is extended or adjusted under 35 U.S.C. 154(b) by 788 days.

(21) Appl. No.: 12/702,194

(22) Filed: Feb. 8, 2010

(65) Prior Publication Data

US 2010/0200529 A1 Aug. 12, 2010

Related U.S. Application Data

(60) Provisional application No. 61/150,643, filed on Feb. 6, 2009.

(51) Int. Cl.
*B66C 23/44* (2006.01)

(52) U.S. Cl.
USPC ..... 212/180; 212/177; 254/323; 414/543; 414/462

(58) Field of Classification Search
USPC .. 254/323, 324, 325, 326, 327, 328; 212/180, 212/177, 176; 414/543, 462
See application file for complete search history.

(56) References Cited

U.S. PATENT DOCUMENTS

| | | | | | |
|---|---|---|---|---|---|
| 2,509,950 | A | * | 5/1950 | Zierke | 414/543 |
| 2,804,216 | A | * | 8/1957 | Farnam | 414/543 |
| 3,024,925 | A | * | 3/1962 | Werner et al. | 414/543 |
| 3,176,861 | A | * | 4/1965 | Paul et al. | 414/543 |
| 3,578,179 | A | * | 5/1971 | Fujioka | 212/180 |
| 3,845,869 | A | * | 11/1974 | Sowers et al. | 212/180 |
| 4,069,922 | A | * | 1/1978 | Hawkins | 212/181 |
| 4,383,792 | A | | 5/1983 | Seabloom et al. | |
| 4,419,038 | A | * | 12/1983 | Pendergraft | 414/543 |
| 4,671,731 | A | * | 6/1987 | Harlan | 414/550 |
| 4,881,864 | A | * | 11/1989 | Amato | 414/543 |
| 5,090,580 | A | * | 2/1992 | Nelson | 212/180 |
| 5,195,726 | A | * | 3/1993 | Kaner | 254/325 |
| 5,520,498 | A | * | 5/1996 | DiBartolomeo | 414/680 |
| 5,725,112 | A | * | 3/1998 | Thorby | 212/180 |
| 5,788,095 | A | * | 8/1998 | Watson | 212/180 |
| 5,971,177 | A | | 10/1999 | Carter | |
| 6,082,561 | A | * | 7/2000 | Bembas | 212/180 |
| 6,138,991 | A | * | 10/2000 | Myers, Jr. | 254/323 |
| 6,202,868 | B1 | * | 3/2001 | Murray | 212/294 |
| 6,478,528 | B1 | * | 11/2002 | Asbury | 414/550 |
| 6,499,610 | B2 | * | 12/2002 | Spitsbergen | 212/179 |
| 6,799,935 | B1 | | 10/2004 | Grollitsch | |
| 6,821,075 | B2 | * | 11/2004 | van der Horn | 414/462 |

(Continued)

OTHER PUBLICATIONS

Aug. 26, 2007. Harbor Freight, Excerpt from www.harborfreight.com.

(Continued)

*Primary Examiner* — Emmanuel M Marcelo
(74) *Attorney, Agent, or Firm* — Austin Rapp & Hardman

(57) ABSTRACT

A truck-mounted crane is disclosed. The truck-mounted crane may include an elongated pole member, a pivoting arm pivotally attached to the elongated pole member, a support member secured to the elongated pole member, an extension member secured to the support member, an elongated securing member, and an anchoring member. When secured to a truck, the support member may rest on the rim of a truck bed with the secured extension member being positioned within a socket of the truck bed rim. In such configuration, one end of elongated pole member may be pivotally attached to the pivoting arm and the other end of the elongated pole member may be secured to a cargo loop of a truck using the elongated securing member and an anchoring member.

16 Claims, 9 Drawing Sheets

U.S. PATENT DOCUMENTS

| | | | | |
|---|---|---|---|---|
| 6,981,834 | B1 * | 1/2006 | Henry | 414/462 |
| 7,070,059 | B1 * | 7/2006 | Flowers et al. | 212/180 |
| 7,111,744 | B2 * | 9/2006 | Brannan et al. | 212/180 |
| 7,407,151 | B2 * | 8/2008 | Rabska et al. | 254/345 |
| 7,419,347 | B1 * | 9/2008 | Cormier | 414/462 |
| 7,607,546 | B1 * | 10/2009 | Hopper | 212/180 |
| 7,845,622 | B1 * | 12/2010 | Riggs | 254/326 |
| 2004/0256607 | A1 * | 12/2004 | Spitsbergen | 254/334 |
| 2007/0290181 | A1 * | 12/2007 | Bell | 254/323 |

OTHER PUBLICATIONS

Aug. 26, 2007. Photographs of one or more embodiments of Applicant's invention.
Oct. 17, 2007. Grainger Industrial Supply, Search results from www.grainger.com.
Oct. 17, 2010. Hand Winch Cranes & Magnets, McMaster-Carr.
Oct. 18, 2007. Material Handling Solutions, Excerpt from www.e-rackonline.com/.
Oct. 18, 2007. Global Industrial, Excerpt from www.globalindustrial.com.
Oct. 18, 2007. Western Mule Cranes, Excerpt from www.westernmule.com.
Oct. 18, 2007. eBay, Excerpt from www.ebay.com.
Oct. 31, 2007. Photographs of one or more embodiments of Applicant's invention.
Nov. 8, 2007. Photographs of one or more embodiments of Applicant's invention.
Nov. 23, 2007. Bruno, Excerpt from www.bruno.com/.
Jan. 9, 2008. Photographs of one or more embodiments of Applicant's invention.
Feb. 2, 2008. Photographs of one or more embodiments of Applicant's invention.

* cited by examiner

REMOVABLE TRUCK-MOUNTED CRANE

RELATED APPLICATIONS

This application is related and claims priority to U.S. Provisional Patent Application Serial No. 61/150,643 filed on Feb. 6, 2009, for Jib Arm, with Moises Vaquera listed as the inventor, which is incorporated herein by reference.

TECHNICAL FIELD

The present invention relates generally to a crane. More specifically, the present invention relates a crane that is conveniently mountable to and removable from a pick-up truck.

BACKGROUND

Pick-up trucks are known and used throughout the world and are very popular. These trucks have a "bed" which is designed to haul cargo, equipment, and other items. For this reason, trucks are often used by construction workers, movers, farmers, and/or other persons who may need to haul items or cargo.

Trucks may also haul heavy equipment such as air compressors, generators, or other types of equipment. Unfortunately, in order to haul such equipment, the equipment must first be lifted into the bed of the pick-up truck. This generally requires one or more persons physically lifting the equipment into the truck bed. Obviously, this may be a very difficult and laborious task, depending upon the size and weight of the equipment.

Some trucks may be retro-fit with a "lift-gate" or other mechanical or hydraulic device that may be raised and lowered to facilitate the placement of equipment or items into the truck bed. Unfortunately, such lift-gates are generally very expensive and require professional installation. The average consumer generally will not spend the funds necessary to install such a device on their truck. Accordingly, there is a need for a new type of lifting device that is relatively inexpensive and easy to install and remove. Such a device is disclosed herein.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

DETAILED DESCRIPTION

Figure 1:
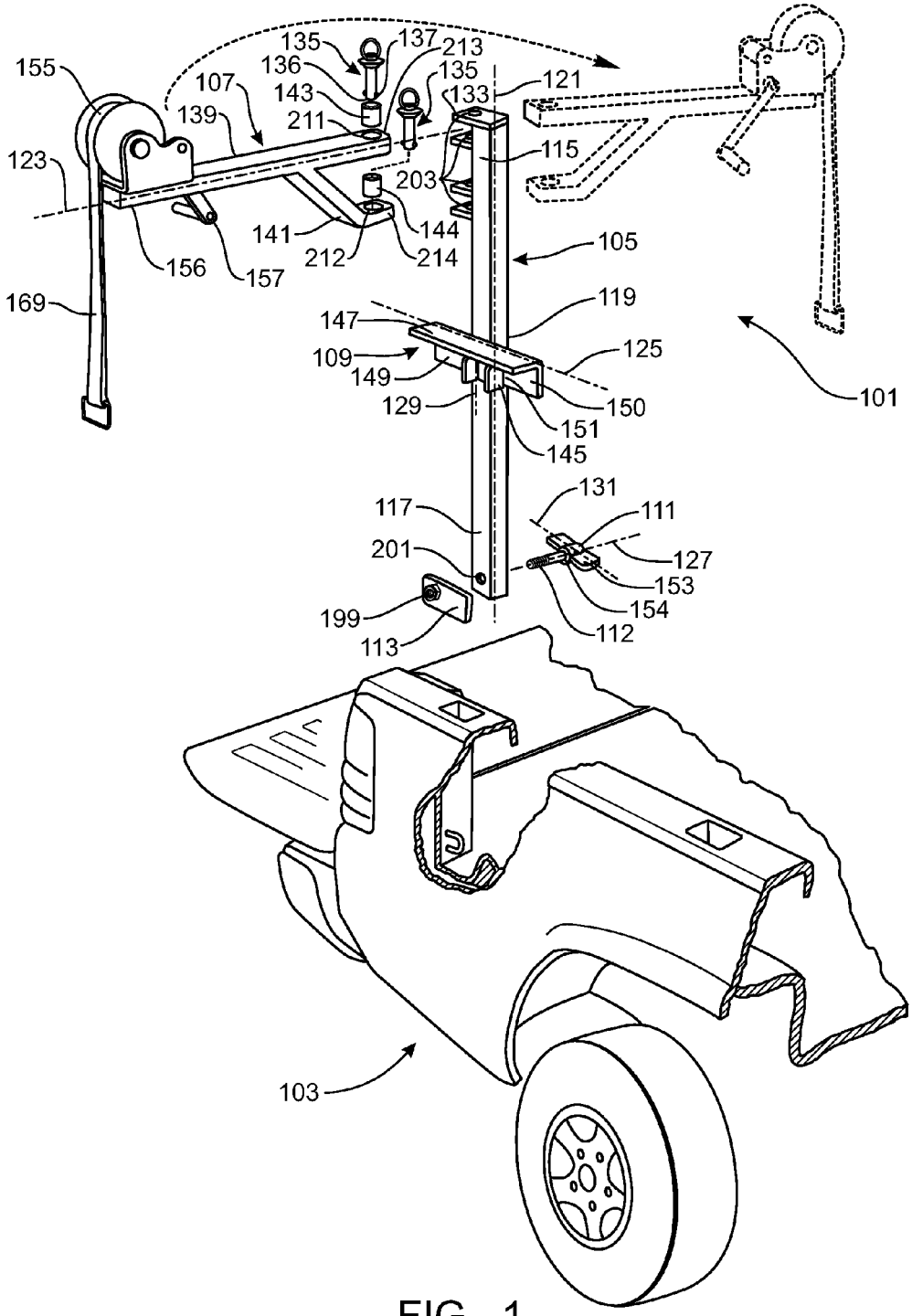
FIG. 1 is an exploded, prospective view of one embodiment of the truck-mounted crane shown with a truck.

A truck-mounted crane is disclosed. In one embodiment, the truck-mounted crane includes an elongated pole member having a first end section, a second end section, a midrange section, and a longitudinal axis. The second end section may define an aperture for receiving an elongated securing member. The elongated member may have a threaded end. In one embodiment, the elongated securing member may comprise a second end opposite the threaded end having a longitudinal axis and at least one planar member secured to the second end. In such an embodiment, the planar member may have a longitudinal axis that is may be disposed generally perpendicular to the longitudinal axis of the elongated securing member.

The truck-mounted crane may also include a pivoting arm that may be pivotally attachable to the first end section of the elongated pole member. The pivoting arm may comprise a main arm and a support arm. A support member may be secured to the midrange section of the elongated pole member. The support member may also comprise a longitudinal axis, a first plane-shaped member extending away from the pole member, and a second plane-shaped member secured to and abutting the elongated pole member. The first plane-shaped member may be disposed in a generally perpendicular configuration relative to the second plane-shaped member to define an enclosed space. The longitudinal axis of the support member may be generally perpendicular to the longitudinal axis of the elongated pole member.

An extension member may be secured to the first plane-shaped member within the enclosed space. The extension member may further have an axis of extension in a direction away from the first plane-shaped member. The axis of extension of the extension member may be, in one embodiment, generally parallel to the longitudinal axis of the elongated pole member and generally perpendicular to the first plane-shaped member. The extension member and the first and second plane-shaped members may define an intervening space. The intervening space may be generally in the shape of a rectangular hexahedron.

The truck-mounted crane may further comprise an anchoring plate. The anchoring plate may define a threaded opening for receiving and being secured to the threaded end of the elongated securing member when the elongated securing member is positioned within the aperture.

In one embodiment, the crane may be secured to and removed from a truck without modification of the truck.

A method for securing an embodiment of a truck-mounted crane to a truck is disclosed. The method may include positioning the extension member within a socket of a truck bed rim of the truck such that the support member abuts the truck bed rim. The method may also include sliding the threaded end of the elongated securing member through an aperture defined by the second end section of the elongated pole member and through an open area of a truck bed cargo loop of the truck. Also, this method may include securing the threaded end of the elongated securing member to the threaded opening in the anchoring plate such that the truck bed cargo loop may be secured between the second end section of the elongated pole member and the anchoring plate.

A method of removing a truck-mounted crane from a truck is also disclosed, the crane being previously secured to the truck. The method may include unsecuring the threaded end of the elongated securing member from the threaded opening in the anchoring plate. This method may also comprise removing the threaded end of the elongated securing member from an open area of a truck bed cargo loop. This method may further comprise removing the extension member from a socket of a truck bed rim of the truck such that the support member no longer abuts the truck bed rim.

In one embodiment, a truck-mounted crane includes an elongated pole member having a first end section, a second end section, a midrange section, and a longitudinal axis, the second end section defining an aperture for receiving an elongated securing member. Such an embodiment may further include a pivoting arm that may be pivotally attachable to the first end section of the elongated pole member.

Certain embodiments of the truck-mounted crane may include a support member secured to the midrange section of the elongated pole member, the support member comprising a longitudinal axis, a first plane-shaped member extending away from the pole member, and a second plane-shaped member secured to and abutting the elongated pole member. The first plane-shaped member may be disposed in a generally perpendicular configuration relative to the second plane-shaped member to define an enclosed space. The longitudinal axis of the support member may be generally perpendicular to the longitudinal axis of the elongated pole member. In such an embodiment, an extension member may be secured to the first plane-shaped member within the enclosed space and may have an axis of extension in a direction away from the first plane-shaped member. The axis of extension of the extension member may be generally parallel to the longitudinal axis of the elongated pole member and generally perpendicular to the first plane-shaped member. The extension member and the first and second plane-shaped member may define an intervening space. Such an embodiment may include an anchoring member that may be mechanically couplable to or may comprise a portion of a unitary member with the elongated securing member. The anchoring member may have a larger lateral dimension than the elongated securing member.

The pivoting arm may comprise a distal end section and the crane may further comprise a winch that may be attachable to the distal end section of the pivoting arm.

The anchoring member may be mechanically couplable to or may comprise a unitary member with the elongated securing member to form a securing hook. The anchoring member, in one embodiment, may comprise a curved portion of a J-bolt and the elongated securing member may comprise a generally linear portion of the J-bolt. The elongated securing member may further comprise a quick release assembly, the elongated securing member being securable to and releasable from the anchoring member employing the quick release assembly.

The elongated securing member may further define a laterally positioned hole on a distal end portion of the elongated securing member for receiving a cotter pin, and the anchoring member may comprise a planar member having an opening for receiving the elongated securing member.

In one embodiment, a truck-mounted crane may comprise an elongated pole member having a first end section, a second end section, a midrange section, and a longitudinal axis. The second end section may define an aperture for receiving an elongated securing member with the elongated securing member having a threaded end. A pivoting arm that may be pivotally attachable to the first end section of the elongated pole member with the pivoting arm comprising a distal end section. A support member may be secured to the midrange section of the elongated pole member. The support member comprising a longitudinal axis, a first plane-shaped member extending away from the pole member, and a second plane-shaped member secured to and abutting the elongated pole member. The first plane-shaped member may be disposed in a generally perpendicular configuration relative to the second plane-shaped member to define an enclosed space. The longitudinal axis of the support member may be generally perpendicular to the longitudinal axis of the elongated pole member. An extension member may be secured to the first plane-shaped member within the enclosed space and may have an axis of extension in a direction away from the first plane-shaped member. The axis of extension of the extension member may be generally parallel to the longitudinal axis of the elongated pole member and generally perpendicular to the first plane-shaped member. The extension member and the first and second plane-shaped member may define an intervening space. The extension member may comprise at least three planar members arranged in a generally rectangular hexahedron configuration with two open sides. An embodiment of the truck-mounted crane may include an anchoring plate defining a threaded opening for receiving and being secured to the threaded end of the elongated securing member when the elongated securing member is positioned within the aperture. A winch that may be attachable to the distal end section of the pivoting arm may also be included in certain embodiments.

In one embodiment, a first distance between a proximal surface of the first plane-shaped member and an aperture defined by the second end section of the elongated pole member may be approximately equal to a second distance between a surface of a truck bed rim and an open area of a cargo loop such that the proximal surface of the first plane-shaped member may be positioned on a surface of the truck bed rim and the elongated securing member may be positioned through the open area of the cargo loop when the elongated securing member is positioned in the aperture defined by the second end section of the elongated pole member to secure the cargo loop between the anchoring plate and the second end section.

The extension member may be sized to be positioned within a socket of a truck bed rim with the intervening space being sized to receive a proximal lip of the truck bed intermediate the socket and an interior side of a truck bed lip.

In one embodiment, the crane may be secured to and removed from a truck without modification of the truck.

In one embodiment, the elongated securing member may comprise a second end opposite the threaded end having a longitudinal axis and at least one planar member secured to the second end. In such an embodiment, the planar member may have a longitudinal axis that may be disposed generally perpendicular to the longitudinal axis of the elongated securing member.

A method for securing an embodiment of a truck-mounted crane to a truck is disclosed. The method may include positioning the extension member within a socket of a truck bed rim of the truck such that the support member abuts the truck bed rim. The method may also include sliding the threaded end of the elongated securing member through an aperture defined by the second end section of the elongated pole member and through an open area of a truck bed cargo loop of the truck. Also, this method may include securing the threaded end of the elongated securing member to the threaded opening in the anchoring plate such that the truck bed cargo loop may be secured between the second end section of the elongated pole member and the anchoring plate.

A method of removing a truck-mounted crane is also disclosed, the crane being previously secured to the truck. The method may include unsecuring the threaded end of the elongated securing member from the threaded opening in the anchoring plate. This method may also comprise removing the threaded end of the elongated securing member from an open area of a truck bed cargo loop. This method may further comprise removing the extension member from a socket of a truck bed rim of the truck such that the support member no longer abuts the truck bed rim.

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the Figures, is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

It should be noted that in certain drawings in which multiple identical or similar components or features appear at various places in the drawings, only one or select number of these components or features are identified with reference numbers in order to prevent the drawings from becoming cluttered with reference numbers. In cases where only a single one or select number of these items or features are identified with reference numbers, the reference numbers in the following description refer to all or a select number of these items, whether or not specifically identified with a reference number.

FIG. 1 is an exploded, view of one embodiment of the truck-mounted crane 101 shown with a truck 103. The embodiment in FIG. 1 includes an elongated pole member 105, a pivoting arm 107, a support member 109, an elongated securing member 111, and an anchoring plate 113 (a type of anchoring member 113). The elongated pole member 105 may include a first end section 115, a second end section 117, a midrange section 119, and a longitudinal axis 121. The pivoting arm 107 may be pivotally attached to the first end section 115 of the elongated pole member 105. The support member 109 may be secured to the midrange section 119 of the elongated pole member 105. The second end section 117 may define an aperture 201 for receiving the elongated securing member 111 having a threaded end 112. As illustrated in FIG. 1, the elongated securing member 111 may comprise a thumbscrew 111.

The illustrated elongated pole member 105 has a generally square or rectangular cross-sectional shape. Other embodiments may come within the scope of the disclosed elongated pole member 105. For example, the elongated pole member 105 may have a round, elliptical, semicircular, symmetrical, or non-symmetrical cross-sectional shape. In one configuration, the elongated pole member 105 may be constructed of 1 ½inch steel square tube with walls that are ⅛inch thick.

As indicated above, the pivoting arm 107 may be pivotally attachable to the first end section 115 of the elongated pole member 105. The first end section 115 of the elongated pole member 105 may include hinge brackets 133 defining apertures 203 for receiving quick pins 135. The quick pins 135 include a spring-biased protuberance 137 protruding transversely from a distal end 136 of the quick pin 135. The spring-biased protuberance 137 of a quick pin 135 creates a snap fit between the apertures 203 in the hinge brackets 133 and the quick pins 135, mitigating the risk that a quick pin 135 will be inadvertently removed or be propelled out of position once situated within the apertures 203 of the hinge brackets 133. In lieu of a quick pin 135, other mechanisms may be employed. For example, a nut and bolt could be utilized or a shaft with a large head and a hole at the opposite end for receiving a cotter pin (e.g., an R-clip) could also be employed. In one embodiment, the quick pins 135 have an outer diameter of ⅜of an inch. The hinge brackets 133 receive and allow a pivoting interaction between the elongated pole member 105 and the pivoting arm 107.

The pivoting arm 107 may optionally include a main arm 139 and a support arm 141, as illustrated in FIG. 1. In an alternative embodiment (not shown), a support plate or bracket may be positioned between the main arm 139 and support arm 141. In one embodiment, only a single arm may be utilized with one or more pivoting connection points with the first end section 115 of the elongated pole member 105. In the illustrated embodiment, proximal ends of the main arm 139 and support arm 141 may define apertures 211, 212 for receiving bushings 143, 144. The proximal ends 213, 214 of the main arm 139 and support arm 141 are those ends which are nearest the elongated pole member 105 when the pivoting arm 107 is pivotally secured to the elongated pole member 105. In one configuration, the main arm 139 may be formed of 1 ½inch steel square tube with ⅛inch thick walls and the support arm 141 may be formed of 1 ¼inch steel square tube, also having ⅛inch thick walls. A longitudinal axis 123 of the main arm 139 may be generally perpendicular to a longitudinal axis 125 of the elongated support member 109 when the truck-mounted crane 101 is assembled.

Bushings 143, 144 may be respectively positioned within the apertures 211, 212, as shown in FIG. 1. The bushings 143, 144 may be secured within the apertures 211, 212 using, for example, welding techniques or a snap fit interaction. The bushings 143, 144 add strength to and mitigate wear to the pivoting arm 107. In one embodiment, the bushings 143, 144 are omitted from the design. The bushings 143, 144, in one configuration, may have an inner diameter of ⅜ths of an inch and an outer diameter of ⅝ths of an inch. Alternative pivoting mechanisms may be employed within the scope of the disclosed truck-mounted crane 101.

The support member 109 may be secured to the midrange section 119 of the elongated pole member 105. The support member 109 may comprise a longitudinal axis 125 with a first plane-shaped member 147 extending away from the pole member, and a second plane-shaped member 149 secured to and abutting the elongated pole member 105. In one embodiment, as illustrated, the first plane-shaped member 147 may be disposed in a generally perpendicular configuration relative to the second plane-shaped member 149 to define an enclosed space 150. The longitudinal axis 125 of the support member 109 may be generally perpendicular to the longitudinal axis 121 of the elongated pole member 105.

An extension member 145 may be secured to the first plane-shaped member 147 within the enclosed space 150. The extension member 145 has an axis of extension 129 in a direction away from the first plane-shaped member 147. The axis of extension 129 may be generally parallel to the longitudinal axis 121 of the elongated pole member 105 and generally perpendicular to the first plane-shaped member 147. The extension member 145 and the first and second plane-shaped member 147, 149 may define an intervening space 151, which is illustrated more clearly in FIG. 3C. In one embodiment, the intervening space 151 may be generally in the shape of a rectangular hexahedron.

Continuing with the description of FIG. 1, an anchoring plate 113 may define a threaded opening 199 for receiving and being secured to the threaded end 112 of the elongated securing member 111 when the elongated securing member 111 is positioned within the aperture 201 defined by the second end section 117 of the elongated pole member 105.

The anchoring plate 113 illustrated in FIG. 1 is rectangular in shape. Alternative embodiments are possible within the scope of the disclosed subject matter, such as an anchoring plate 113 that is, for example, square, oval, octagonal, or round. The threaded opening 199 may be located at various positions on the anchoring plate 113, such as at a vertical and horizontal center of the anchoring plate 113.

As illustrated in FIG. 1, the elongated securing member 111 may comprise a second end 154 opposite the threaded end and having a longitudinal axis 127. At least one planar member 153 may be secured to the second end 154. The planar member 153 has a longitudinal axis 131 that may be disposed generally perpendicular to the longitudinal axis 127 of the elongated securing member 111. The planar member 153 enables manual rotation of the elongated securing member 111 (i.e., rotation without the use of tools), which facilitates installation and removal of the crane 101.

A winch 155 may be attachable to a distal end section 156 of the pivoting arm 107. The distal end section 156 of the pivoting arm 107 may be defined as the section of the arm 107 most remote from the elongated pole member 105 when the pivoting arm 107 is secured to the elongated pole member 105 in a pivoting relationship. The illustrated winch 155 is manual or, in other words, hand-powered by a crank 157. A powered winch 155, such as an electrically powered winch 155, may also be employed, as explained in connection with FIGS. 4A-C. The winch 155 may be employed for elevating and lowering objects secured to a winch cable or strap 169.

Figure 2:
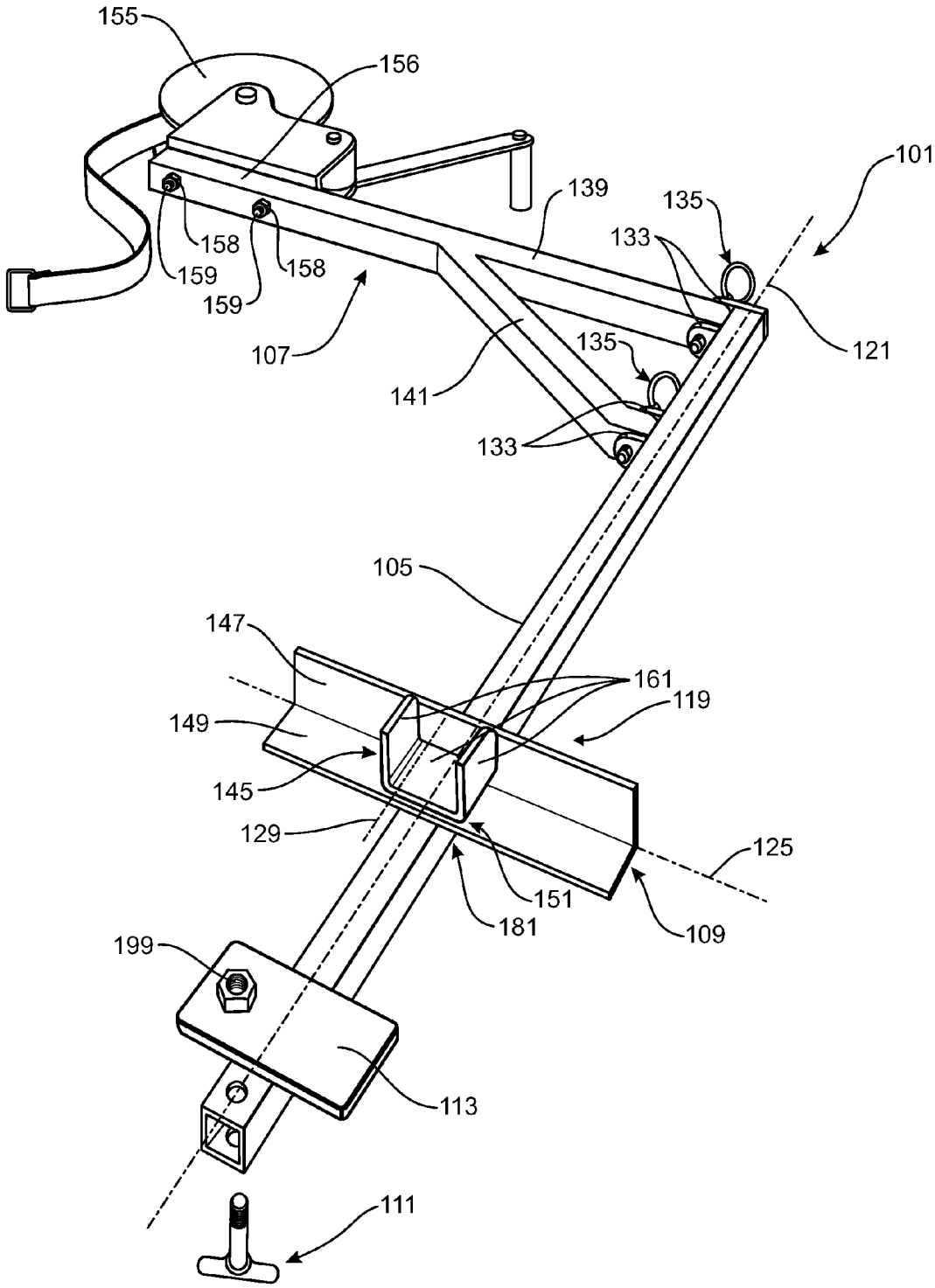
FIG. 2 is a perspective view of one embodiment of a truck-mounted crane.

FIG. 2 is a perspective view of one embodiment of a truck-mounted crane 101. The embodiment shown in FIG. 2 includes an elongated pole member 105, a pivoting arm 107, a support member 109, an elongated securing member 111, and an anchoring plate 113. As illustrated, a winch 155 may be secured to the distal end section 156 of the pivoting arm 107, utilizing two nuts 158 and bolts 159. The pivoting arm 107, which includes a main arm 139 and a support arm 141, may be pivotally attached to the elongated pole member 105 using two hinge brackets 133 and quick pins 135.

The support member 109 may be secured to a midrange section 119 of the elongated pole member 105. As discussed above, the support member 109 includes a longitudinal axis 125, a first plane-shaped member 147 extending away from the pole member 105, and a second plane-shaped member 149 secured to and abutting the elongated pole member 105. The first plane-shaped member 147 may be disposed in a generally perpendicular configuration relative to the second plane-shaped member 149 to define an enclosed space 150. The longitudinal axis 125 of the support member 109 may be generally perpendicular to the longitudinal axis 121 of the elongated pole member 105.

The extension member 145 may be secured to the first plane-shaped member 147 within the enclosed space 150. The extension member 145 may have an axis of extension 129 in a direction away from the first plane-shaped member 147. The axis of extension 129 of the extension member 145, as shown in the illustrated embodiment, may be generally parallel to the longitudinal axis 121 of the elongated pole member 105 and generally perpendicular to the first plane-shaped member 147.

In one embodiment, which is illustrated in FIG. 2, the extension member 145 may comprise at least three planar members 161 arranged in a generally rectangular hexahedron configuration 181 with two open sides. As illustrated, one of the sides of this rectangular hexahedron configuration 181 may be "closed" by the first plane-shaped member 147. The open sides of the rectangular hexahedron configuration 181 may include a bottom side (a side which is most remote from the first plane-shaped member 147) and a remote side (a side which is most remote from the elongated pole member 105). The extension member 145 may be embodied in other ways. For example, the extension member 145 could be of a rectangular hexahedron configuration 181 with all six sides being closed or with one side or three sides being open. Also, support plates or braces may be disposed within the extension member 145. In one embodiment, opposing the extension member 145 may comprise two opposing planar members 161 with an intervening brace (such as a brace with a cross-sectional "I" shape) secured to the first plane-shaped member 147.

The extension member 145 and the first and second plane-shaped member 147, 149 may define an intervening space 151, which will be discussed further below in connection with FIG. 3C.

Figure 3A:
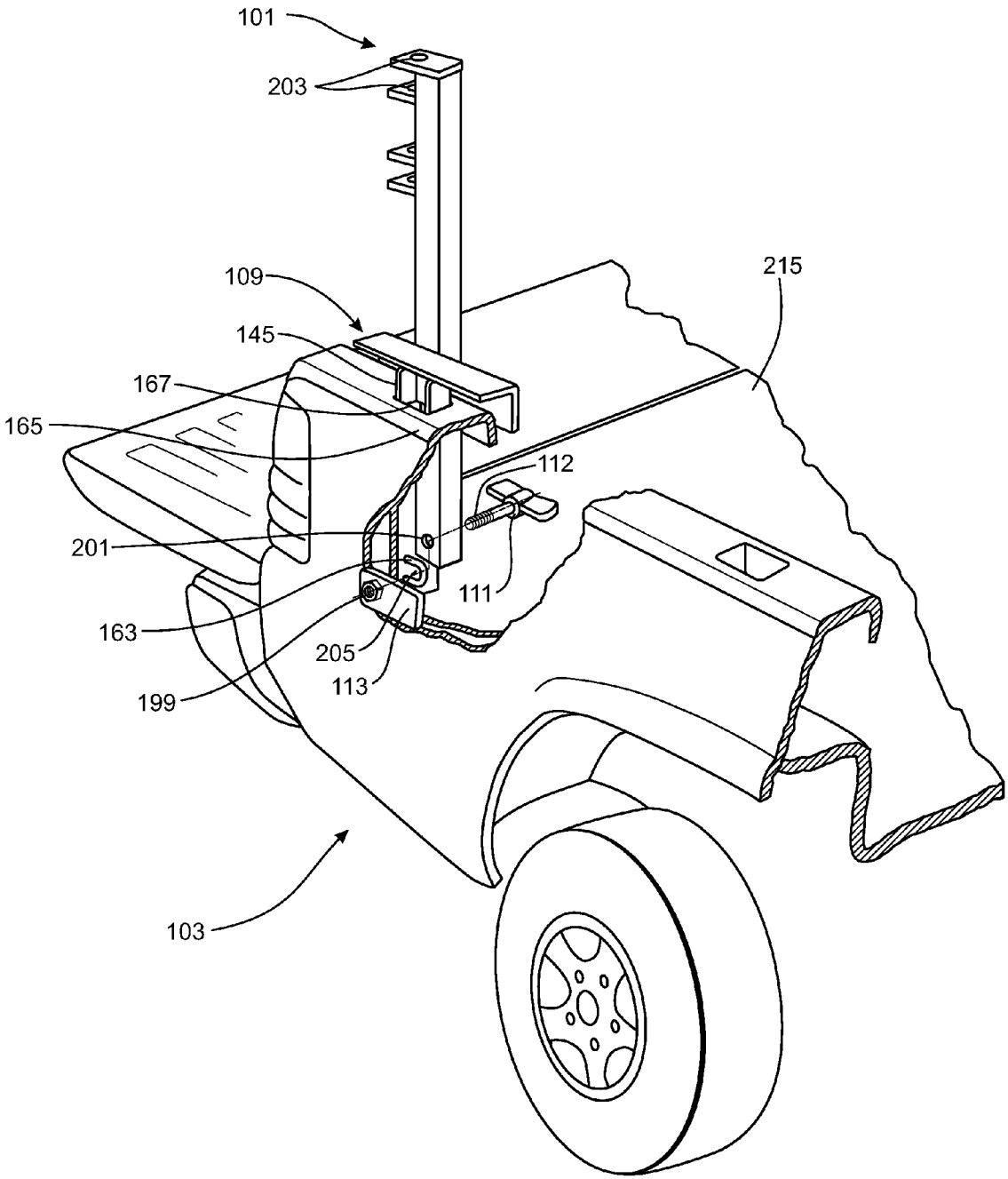
FIGS. 3A-C illustrate various steps of one embodiment of a method for securing a truck-mounted crane to a truck and conversely for removing the truck-mounted crane from the truck.
Figure 3B:
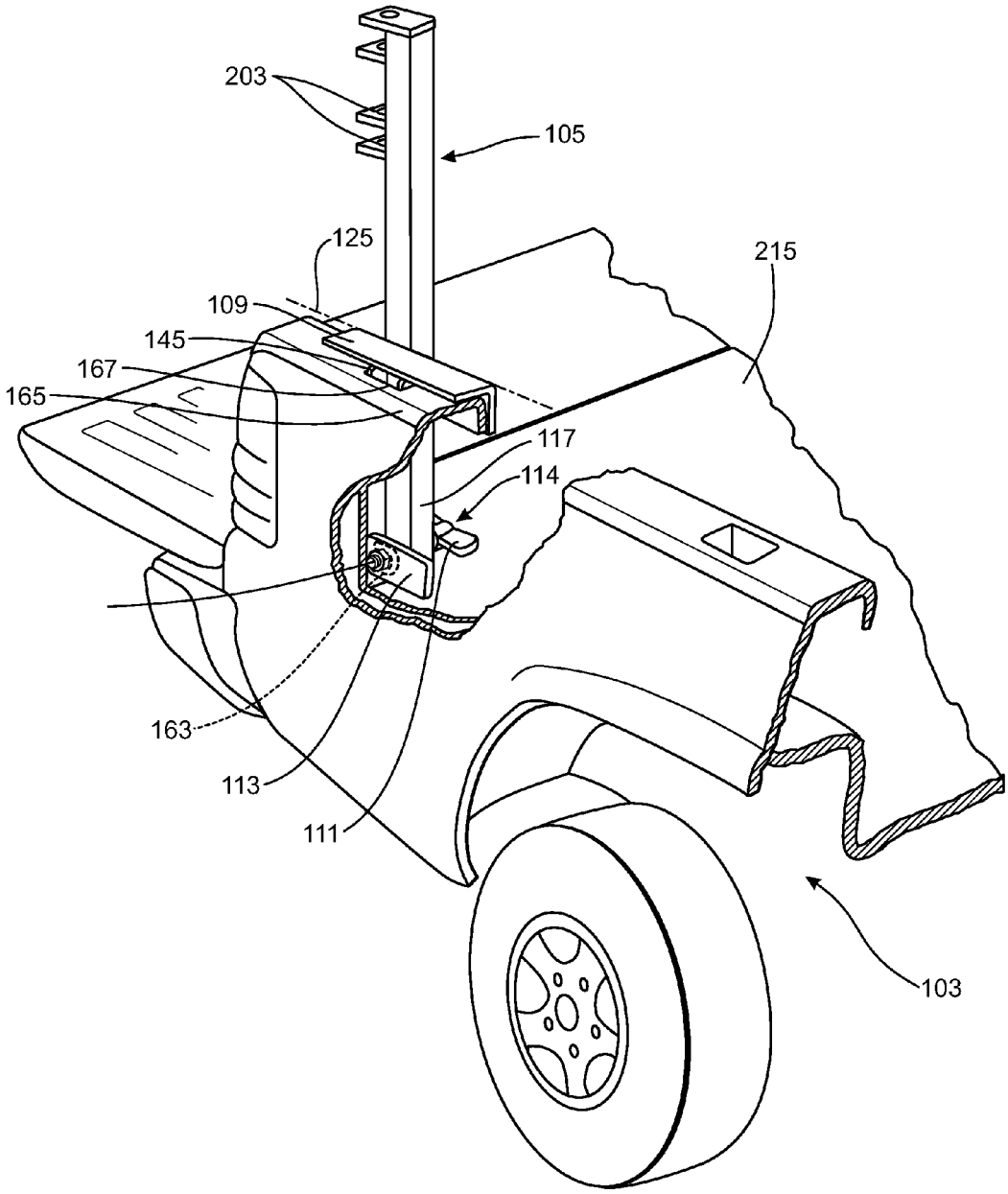
Figure 3C:
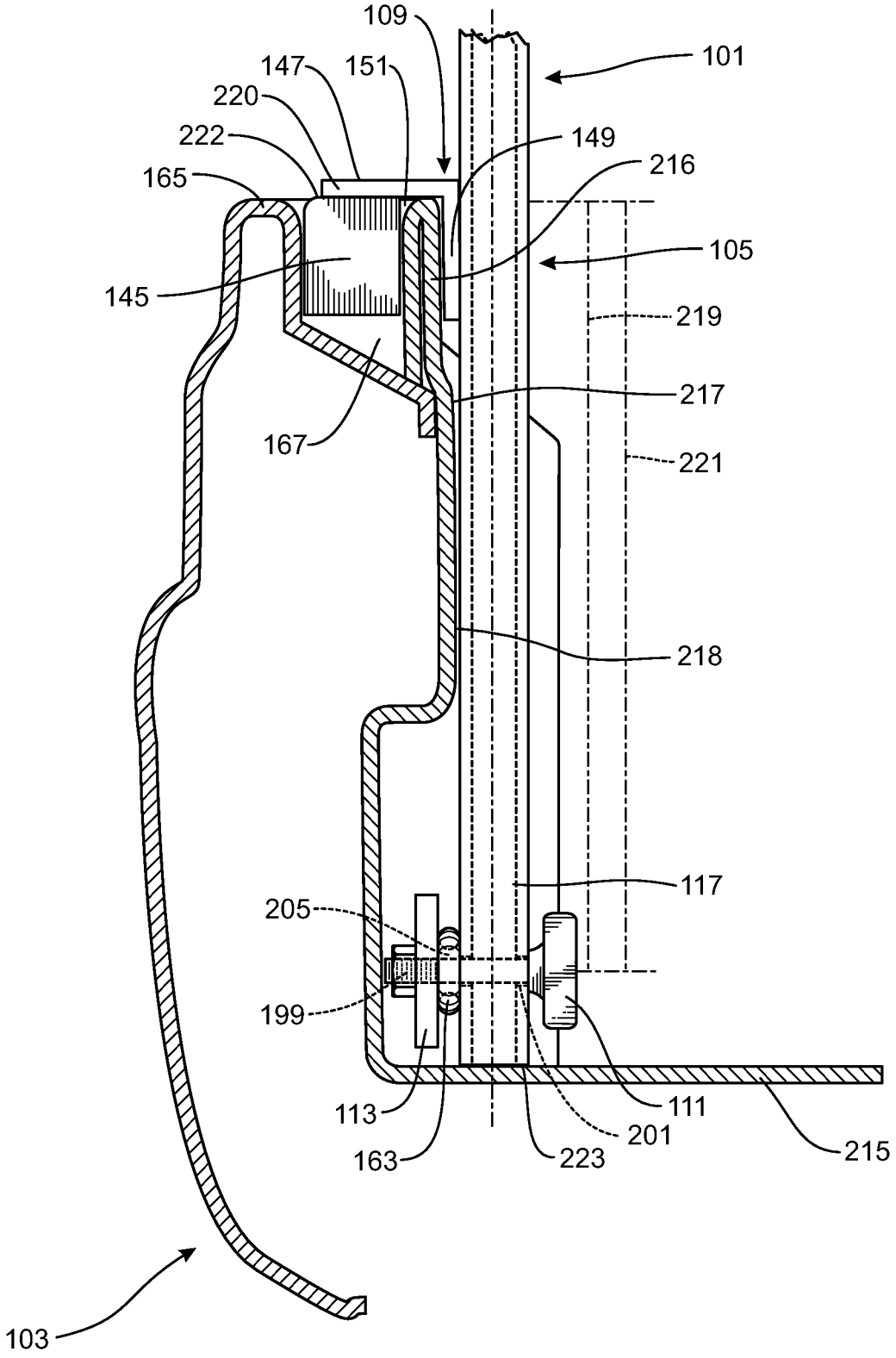

FIGS. 3A-C illustrate various steps of an embodiment of method for installing a truck-mounted crane 101. FIG. 3A is a side perspective view of an embodiment of a truck-mounted crane 101 shown together with a partial cut away view of an illustrated truck bed 215. FIG. 3A illustrates positioning the extension member 145 within a socket 167 of a truck bed rim 165 of the truck 103. As shown in FIG. 3A, the threaded end 112 of the elongated securing member 111 has not yet been inserted into the threaded opening 199 in the anchoring plate 113.

With reference to FIG. 3B, the extension member 145 has been positioned within a socket 167 of the truck bed rim 165 of a truck 103 such that the support member 109 abuts the truck bed rim 165. The dimension of the support member 109 along its longitudinal axis 125 distributes weight along the truck bed rim 165 such that the crane 101 can support and enable movement of relatively large items without damaging the truck bed 215. As illustrated, the threaded end 112 of the elongated securing member 111 has been slid through and is thus positioned within the aperture 201 defined by the second end section 117 of the elongated pole member 105 and through the open area 205 of a truck bed cargo loop 163 of the truck 103. In addition, the threaded end of the elongated securing member 111 has been secured to the threaded opening 199 in the anchoring plate 113 such that the truck bed cargo loop 163 may be secured between the second end section 117 of the elongated pole member 105 and the anchoring plate 113. As shown, the anchoring plate 113 and elongated securing member 111 are mechanically couplable (i.e., mechanically connectable or securable) to form a securing hook 114 to secure the second end section 117 of the elongated pole member 105 to the cargo loop 163.

F*igure* 3C is a side view of a portion of one embodiment of a truck-mounted crane 101 shown together with a partial cut away of a truck bed 215 of a truck 103. As illustrated in FIG. 3C, the truck-mounted crane 101 may be fully installed within the illustrated truck 103. The extension member 145 may be positioned within a socket 167 of the truck bed rim 165. Both the first plane-shaped member 147 and the second plane-shaped member 149 of the support member 109 may abut, or may be in close proximity, the truck bed rim 165.

FIG. 3C clearly illustrates the intervening space 151, which may be defined by the extension member 145 and the first and second plane-shaped members 147, 149. As shown, the intervening space 151 may generally be in the shape of a rectangular hexahedron 181. In addition, the extension member 145 may be sized to be positioned within a socket 167 of a truck bed rim 165 with the intervening space 151 being sized to receive a proximal lip 216 of the truck bed 215 intermediate the socket 167 and interior side 217 of a truck bed rim 165.

The proximal edge 218 of the elongated pole member 105 may be proximate or abut an interior side 217 of the truck bed rim 165. An elongated securing member 111 (which, as illustrated in FIG. 3C, may comprise a thumb screw 111) may be positioned within the aperture 201 defined by the second end section 117 of the elongated pole member 105, through an open area 205 of the cargo loop 163, and secured within the threaded opening 199 defined by the anchoring plate 113. As a result of this configuration, the cargo loop 163 may be securely positioned between the anchoring plate 113 and the second end section 117 of the elongated pole member 105, preventing the second end section 117 of the elongated pole member 105 from pivoting away from the interior side 217 of the truck bed rim 165 when the crane 101 elevates a load.

In addition, a first distance 219 between a proximal surface 220 of the first plane-shaped member 147 and the aperture 201 may be approximately equal to a second distance 221 between a surface 222 of a truck bed rim 165 and an open area 205 of a cargo loop 163 such that the proximal surface 220 of the first plane-shaped member 147 may be positioned on a surface 222 of the truck bed rim 165 and the elongated securing member 111 may be positioned through the open area 205 of the cargo loop 163 when the elongated securing member 111 is positioned in the aperture 201 in the second end section 117 of the elongated pole member 105 to secure the cargo loop 163 between the anchoring plate 113 and the second end section 117. In addition, the support member 109 may be positioned on the midrange section 119 of the elongated pole member 105 such that when the truck-mounted crane 101 is installed on a truck 103, a second end 223 of the elongated pole member 105 may abut the truck bed 215 surface or may be positioned proximate thereto. When the second end 223 of the elongated pole member 105 abuts on the truck bed 215, this may further distribute the weight supported by the crane 101. In view of the foregoing, the truck-mounted crane 101 may be manufactured with different first distances 219 to accommodate different sized trucks 103.

FIGS. 3A-C further serve to illustrate a method of removing the truck-mounted crane 101 from a truck 103. As explained above, FIGS. 3B-C illustrate the truck-mounted crane 101 secured to the truck 103. The threaded end 112 of the elongated securing member 111 may be unsecured from the threaded opening 199 in the anchoring plate 113 and removed from the open area 205 of a truck bed cargo loop 163, as shown in FIG. 3A. In addition, the extension member 145 may be removed from a socket of a truck bed rim 165 of the truck 103 such that the support member 109 no longer abuts the truck bed rim 165, as shown in FIG. 3A.

Thus, as explained in connection with FIGS. 3A-C, the crane 101 may be secured to and removed from a truck bed rim 165, truck bed rim socket 167, and truck bed cargo loop 163 without modification of the truck bed rim 165, the truck bed rim socket 167, or the truck bed cargo loop 163 or any part of the truck 103. In one embodiment, "without modification" of the truck 103 signifies not altering the structure of the truck 103 (such as by drilling a hole in the truck 103).

Figure 4A:
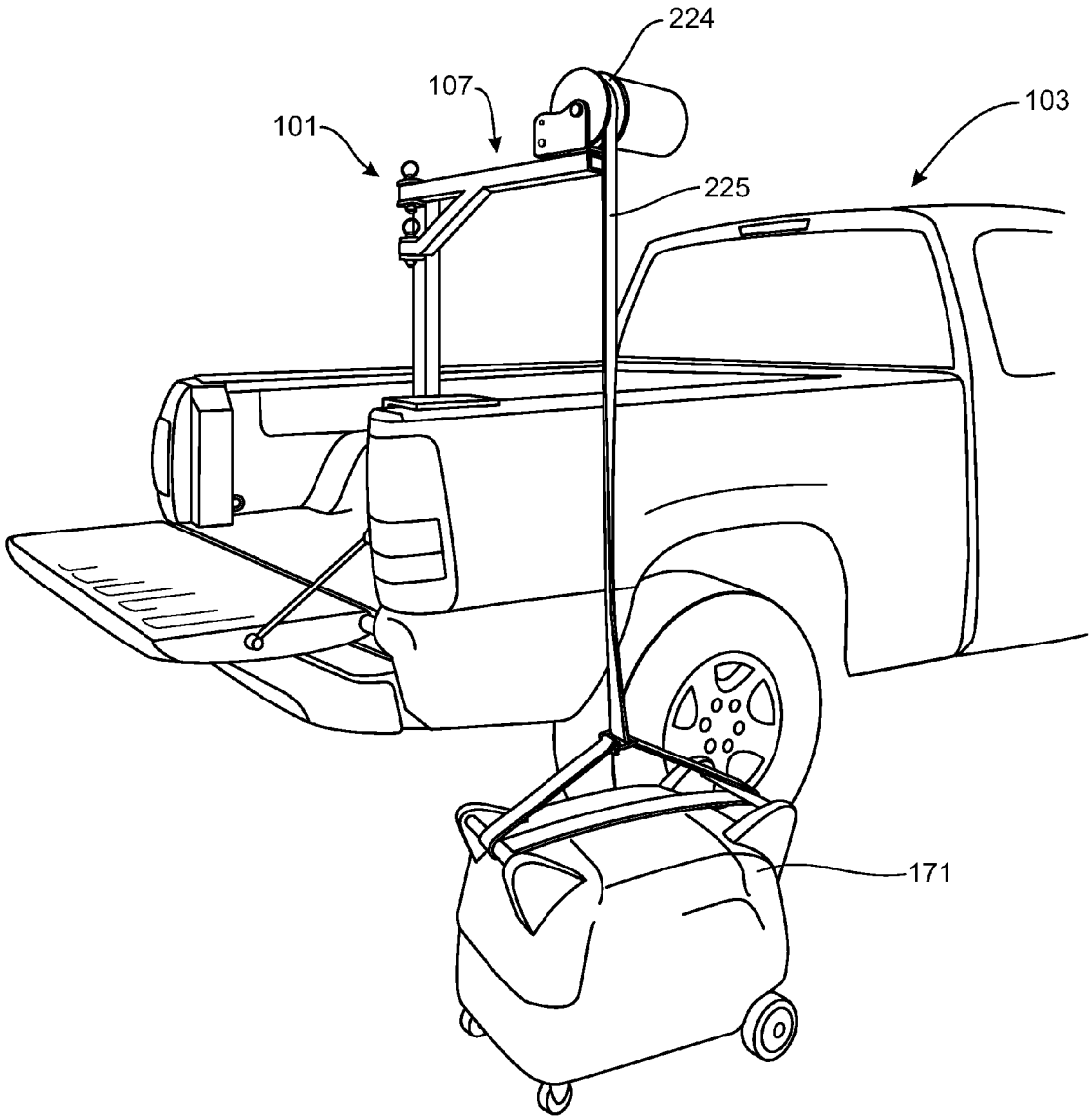
FIGS. 4A-C illustrate an embodiment of a method for using one embodiment of truck-mounted crane.
Figure 4B:
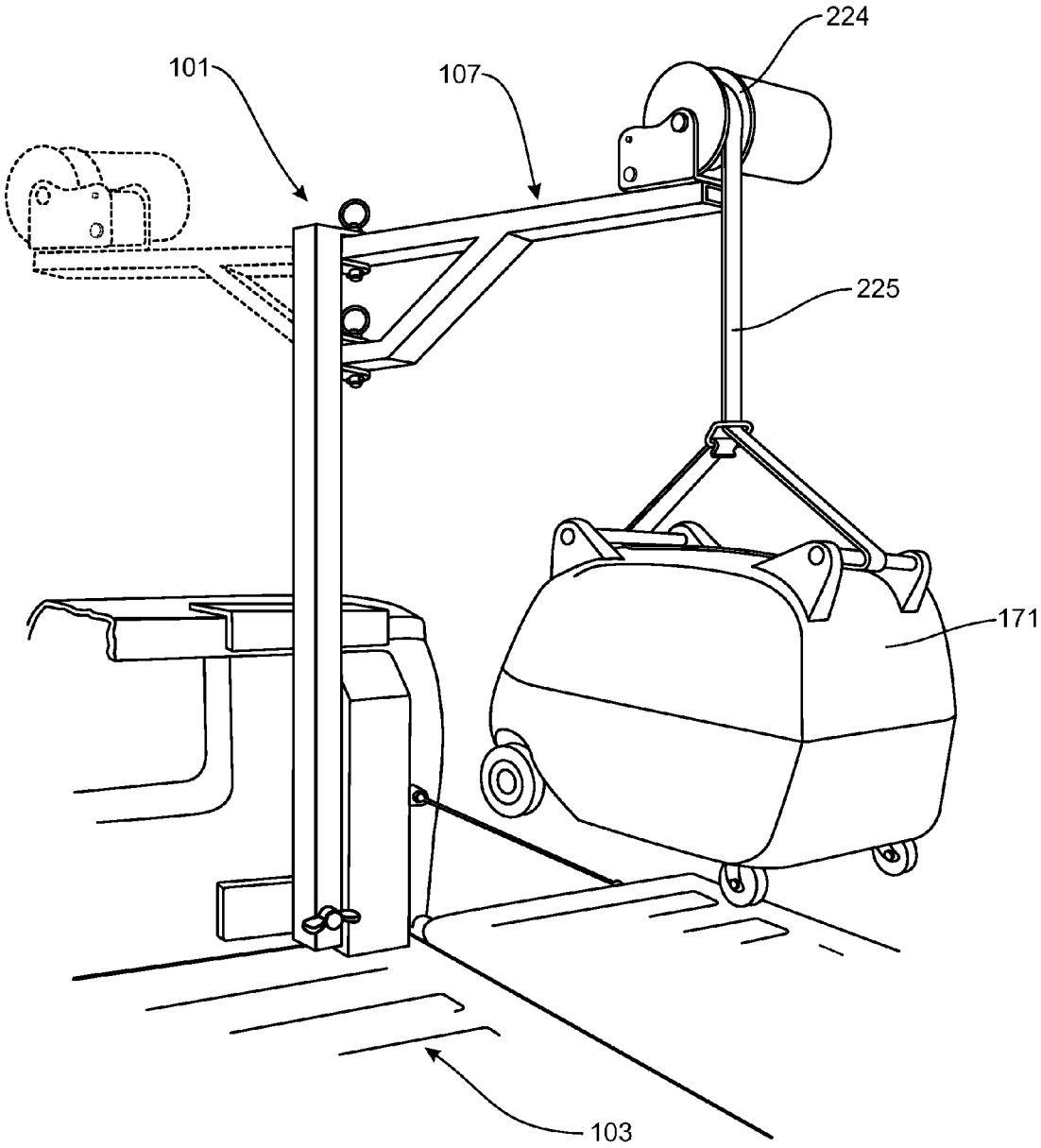
Figure 4C:
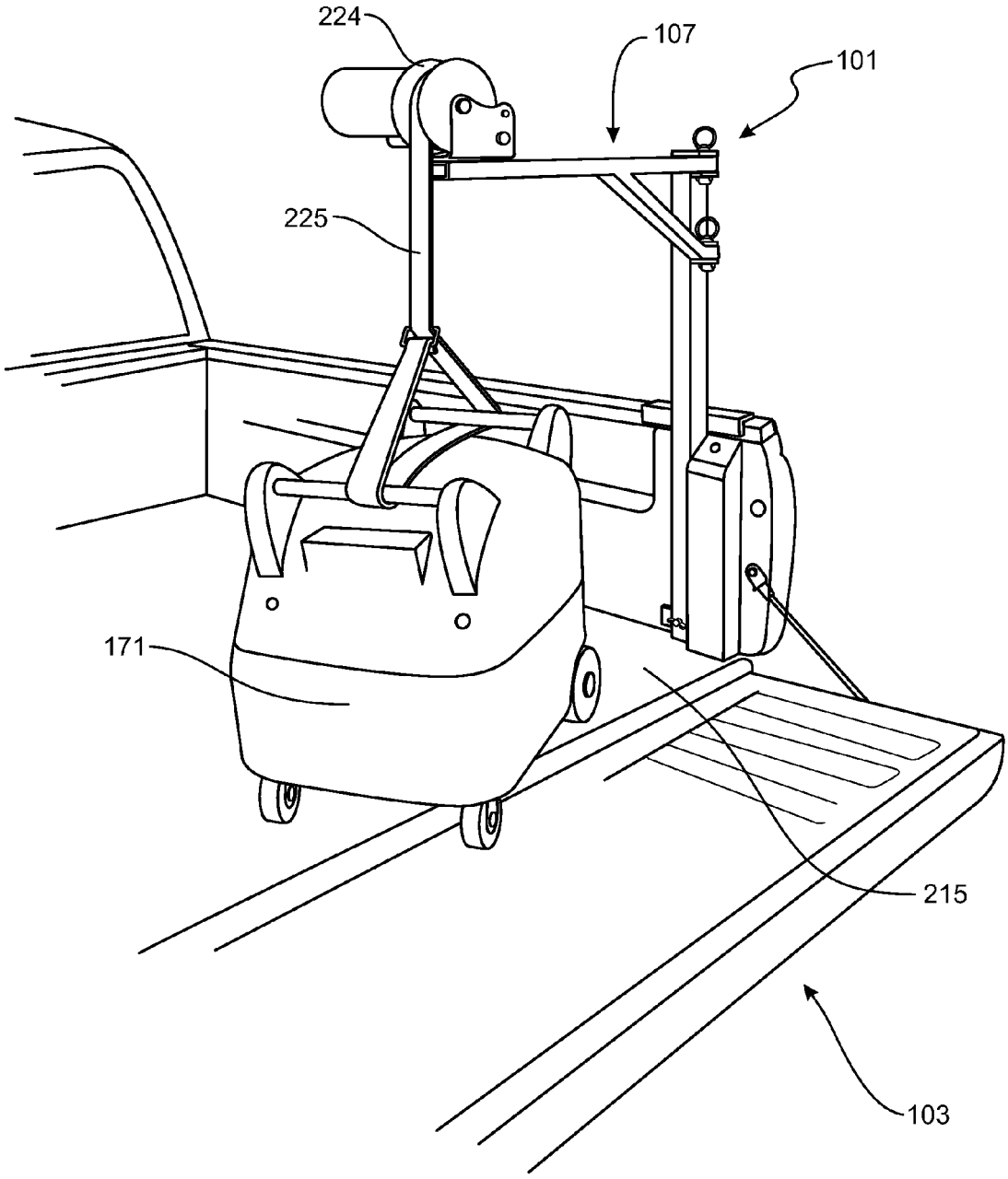

FIGS. 4A-C illustrate one method for using an embodiment of truck-mounted crane 101. As illustrated in FIG. 4A, a cable or strap 225 of the winch 224 (in FIGS. 4A-C, a powered winch 224) may be secured to an object 171, such as the illustrated generator 171. The winch cable or strap 225 may be wound on to the winch 224 to shorten the available length of the cable or strap 225, thus elevating the object 171 from the ground.

The pivoting arm 107 of the truck-mounted crane 101 may be rotated toward the truck 103, as illustrated in FIG. 4B. Thereafter, the winch cable or strap 225 may be unwound from the winch 224 to increase the available length of the cable or strap 225, thus bringing the object 171 to rest within the truck bed 215 of the truck 103, as shown in FIG. 4C. In one embodiment, the pivoting arm 107 of the truck-mounted crane 101 may have a range of motion of approximately 190 degrees.

Figure 5A:
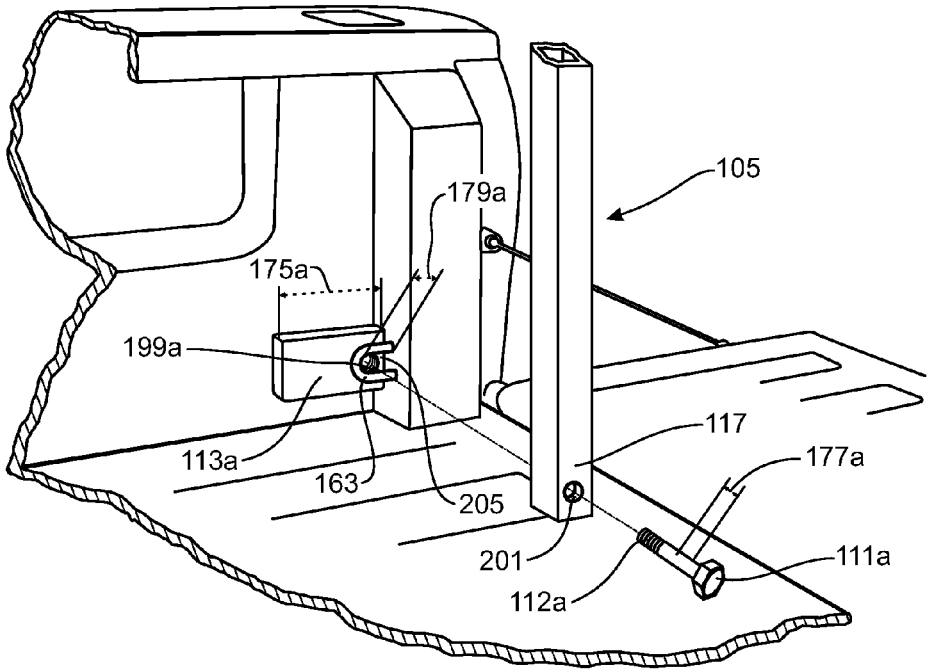
FIGS. 5A-D illustrate various embodiments of elongated securing members and anchoring members of a truck-mounted crane.

FIGS. 5A-D illustrate various embodiments of elongated securing members 111*a*-d of a truck-mounted crane 101. FIG. 5A illustrates an embodiment in which a bolt 111*a* (for example, with a hexagonal head) is employed rather than a thumb screw 111, as illustrated, for example, in FIG. 1. With reference to the embodiment shown in FIG. 5A, the anchor plate 113*a* (a type of anchoring member 113*a*) defines may define a threaded opening 199*a* for receiving the threaded end 112*a* of the bolt 111*a* (a type of elongated securing member 111*a*). The threaded end 112*a* may pass through the aperture 201 in the elongated pole member 105. As disclosed in connection with other embodiments, a cargo loop 163 may be secured between the anchoring member 113*a* and the elongated securing member 111*a*. As illustrated in FIG. 5A, the anchoring member 113*a* has a larger lateral dimension 175*a* than a lateral dimension 177*a* of elongated securing member 111*a* or a lateral dimension 179*a* of the open area 205 defined by the cargo loop 163. The anchoring plate 113*a* and elongated securing member 111*a* are mechanically couplable to form a securing hook (having a generally L-shaped side profile or alternatively, for example, a generally T-shaped side profile) to secure the second end section 117 of the elongated pole member 105 to the cargo loop 163.

Figure 5B:
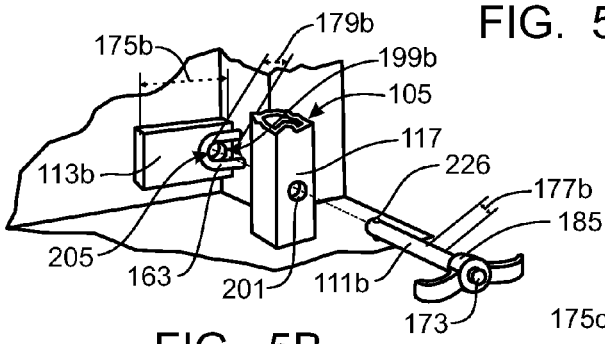

FIG. 5B illustrates an elongated securing member 111*b* that includes a quick release assembly 185. The quick release assembly 185 works in the following manner. A force retains one or more laterally protruding protuberances 226 in a laterally projecting or locked state. The force may be released by pressing a button 173 positioned at the proximal end of the elongated securing member 111*b*, enabling the laterally protruding protuberances 226 to be compressed and moved inside the shaft of the elongated securing member 111*b* in a released or unlocked state. As illustrated, the anchoring member 113*b* of this embodiment may comprise an anchoring plate 113*b*. The anchoring plate 113*b* may define an opening 199*b* for receiving the elongated securing member 111*b*. This opening 199*b* is not necessarily threaded, as with the threaded opening 199 discussed previously. In a released state, the elongated securing member 111*b* may be inserted through the aperture 201 defined by the second end section 117 of the elongated pole member 105, through the open area 205 of the cargo loop 163, and through the opening 199*b* of the anchoring plate 113*b*.At this point, the button 173 may be released, transitioning the laterally extending protuberances 226 into a locked state. The opening 199*b* may be sized such that the laterally extending protuberances 226, in a locked state, abut an area surrounding the opening 199*b* to enable secure retention of the cargo loop 163 between the second end section 117 of the elongated pole member 105 and the anchoring plate 113*b*. Thus, the elongated securing member 111*b* may be securable to and releasable from the anchoring member 113b employing the quick release assembly 185. As illustrated in FIG. 5B, the anchoring member or plate 113*b* has a larger lateral dimension 175*b* than a lateral dimension 177*b* of the elongated securing member 111*b* or a lateral dimension 179*b* of the open area 205 defined by the cargo loop 163. The anchoring plate 113*b* and elongated securing member 111*b* are mechanically couplable to form a securing hook (having a generally L-shaped side profile or alternatively, for example, a generally T-shaped side profile) to form a securing hook to secure the second end section 117 of the elongated pole member 105 to the cargo loop 163.

Figure 5C:
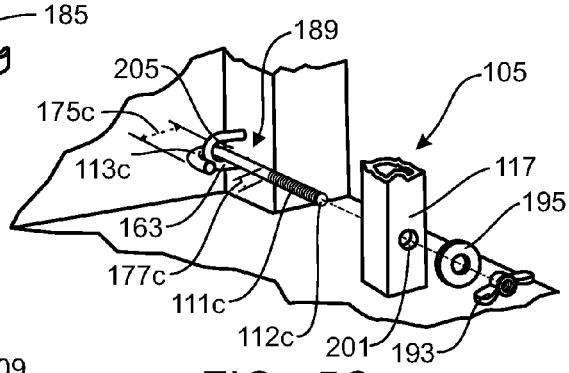

The embodiment illustrated in FIG. 5C does not require an anchoring plate 113, 113*a-b*, d. Instead, a J-bolt 189 may be employed. The J-bolt 189 includes both an anchoring member 113*c* (the generally curved portion 113*c* of the J-bolt 189) and elongated securing member 111*c* (the generally linear portion 111*c* of the J-bolt 189). The anchoring member 113*c* may be inserted through the open area 205 defined by the cargo loop 163 with the second end section 117 of the elongated pole member 105 positioned away from the cargo loop 163, as shown in FIG. 5C. The second end section 117 of the elongated pole member 105 may be moved toward the cargo loop 163, while guiding the elongated securing member 111*c* through the aperture 201 defined by the second end section 117. Thereafter, a washer 195 may be inserted over the threaded end 112*c* of the elongated securing member 111*c* and secured in place using the illustrated wingnut 193. Alternatively, for example, a hex nut could be used in place of the wingnut 193. It should also be noted that a washer 195 could be employed in connection with any of the other embodiments of the elongated securing member 111, 111*a-d* disclosed herein. As illustrated in FIG. 5C, the anchoring member 111*c* has a larger lateral dimension 175*c* than a lateral dimension 177*c* of the elongated securing member 111*c* . The anchoring member 113*c* and elongated securing member 111*c* may comprise portions of a unitary member that comprises (which may comprise a securing hook 189 and may have (a generally J-shaped side profile) to secure the second end section 117 of the elongated pole member 105 to the cargo loop 163.

Figure 5D:
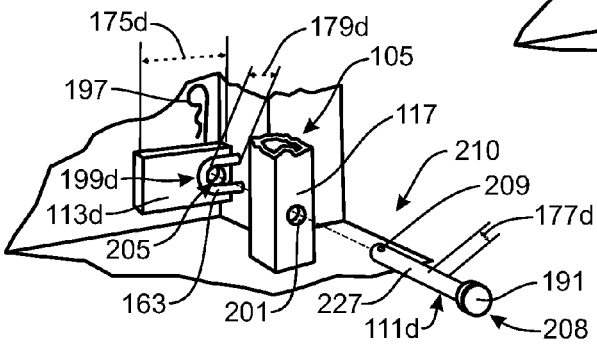

FIG. 5D illustrates another embodiment of the elongated securing member 111*d* and anchoring member 113*d*. In the illustrated embodiment, the elongated securing member 111*d* may comprise a shaft 227 with a head 191 on the proximal end portion 208 of the shaft 227 and laterally positioned hole 209 on the distal end portion 210. As with the embodiment illustrated in FIG. 5B, an opening 199*d* defined by an anchoring member 113*d* (which may comprise a planar member or anchoring plate 113*d*) need not be threaded. The distal end portion 210 of the shaft 227 may be inserted through the aperture 201 defined by the second end section 117 of the elongated pole member 105, through the open area 205 of the cargo loop 163, and through the opening 199*d*. A cotter pin 197, such as the illustrated R-clip 197 or a split pin (not shown), may be securely positioned through the laterally positioned hole 209 to secure the cargo loop 163 between the anchoring plate 113*d* and the second end section 117 of the elongated pole member 105. As illustrated in FIG. 5D, the anchoring member 113*d* has a larger lateral dimension 175*d* than a lateral dimension 177*d* of the elongated securing member 111*d* or a lateral dimension 179*d* of the open area 205 defined by the cargo loop 163. The anchoring plate 113*d* and elongated securing member 111*d* are mechanically couplable to form a securing hook (having a generally L-shaped side profile or alternatively, for example, a generally T-shaped side profile) to secure the second end section 117 of the elongated pole member 105 to the cargo loop 163.

In each of the embodiments disclosed herein, an anchoring member 113, 113*a-d* is may be mechanically couplable to or may comprise unitary member with an elongated securing member 111, 111*a-d*. For example, in connection with the embodiments of FIGS. 5A, 5B, and 5D, a mechanically couplable relationship exists between the anchoring member 113*a-b*, 113*d* and the elongated securing member 111*a-b*, 111*d*. In connection with FIG. 5C, the anchoring member 113*c* may comprise a portion of a unitary member with the elongated securing member 111*c* (i.e., the anchoring member 113*c* and the elongated securing member 111*c* may each comprise a portion of the unitary J-bolt 189). It should be noted that the embodiments of the elongated securing member 111, 111*a-d* and anchoring member 113, 113*a-d* shown herein are merely illustrative.

In one embodiment, generally parallel means being within 5 degrees of being absolutely parallel and generally perpendicular signifies being within 5 degrees of being absolutely perpendicular. In another embodiment, generally parallel means being within 10 degrees of being absolutely parallel and generally perpendicular signifies being within 10 degrees of being absolutely perpendicular. In yet another yet embodiment, generally parallel means being within 15 degrees of being absolutely parallel and generally perpendicular signifies being within 15 degrees of being absolutely perpendicular.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A truck-mounted crane, comprising:

an elongated pole member having a first end section, a second end section, a midrange section, and a longitudinal axis, the second end section defining an aperture for receiving an elongated securing member, the elongated member having a threaded end;

a pivoting arm that is pivotally attachable to the first end section of the elongated pole member;

a support member secured to the midrange section of the elongated pole member, the support member comprising a longitudinal axis, a first plane-shaped member extending away from the pole member, and a second plane-shaped member secured to and abutting the elongated pole member, the first plane-shaped member being disposed in a generally perpendicular configuration relative to the second plane-shaped member, the longitudinal axis of the support member being generally perpendicular to the longitudinal axis of the elongated pole member;

an extension member being secured to the first plane-shaped member and having an axis of extension in a direction away from the first plane-shaped member, the axis of extension of the extension member being generally parallel to the longitudinal axis of the elongated pole member and generally perpendicular to the first plane-shaped member, the extension member and the first and second plane-shaped member defining an intervening space; and an anchoring plate defining a threaded opening for receiving and being secured to the threaded end of the elongated securing member, when the elongated securing member is positioned within the aperture.

2. The crane of claim 1, wherein the intervening space is generally in the shape of a rectangular hexahedron.

3. The crane of claim 1, wherein the pivoting arm comprises a main arm and a support arm.

4. A method securing the crane of claim 1 to a truck, the method comprising:

positioning the extension member within a socket of a truck bed rim of the truck such that the support member abuts the truck bed rim;

sliding the threaded end of the elongated securing member through the aperture defined by the second end section of the elongated pole member and through an open area of a truck bed cargo loop of the truck; and securing the threaded end of the elongated securing member to the threaded opening in the anchoring plate such that the truck bed cargo loop is secured between the second end section of the elongated pole member and the anchoring plate.

5. A method of removing the crane of claim 1 from a truck, the crane being previously secured to the truck, the method comprising:

unsecuring the threaded end of the elongated securing member from the threaded opening in the anchoring plate;

removing the threaded end of the elongated securing member from an open area of a truck bed cargo loop; and removing the extension member from a socket of a truck bed rim of the truck such that the support member no longer abuts the truck bed rim.

6. The crane of claim 1, wherein the elongated securing member comprises a second end opposite the threaded end having a longitudinal axis and at least one planar member secured to the second end, the planar member having a longitudinal axis that is disposed generally perpendicular to the longitudinal axis of the elongated securing member.

7. A truck-mounted crane, comprising:

an elongated pole member having a first end section, a second end section, a midrange section, and a longitudinal axis, the second end section defining an aperture for receiving an elongated securing member;

a pivoting arm that is pivotally attachable to the first end section of the elongated pole member;

a support member secured to the midrange section of the elongated pole member, the support member comprising a longitudinal axis, a first plane-shaped member extending away from the pole member, and a second plane-shaped member secured to and abutting the elongated pole member, the first plane-shaped member being disposed in a generally perpendicular configuration relative to the second plane-shaped member, the longitudinal axis of the support member being generally perpendicular to the longitudinal axis of the elongated pole member;

an extension member being secured to the first plane-shaped member and having an axis of extension in a direction away from the first plane-shaped member, the axis of extension of the extension member being generally parallel to the longitudinal axis of the elongated pole member and generally perpendicular to the first plane-shaped member, the extension member and the first and second plane-shaped members defining an intervening space; and an anchoring member that is mechanically couplable to or comprises a portion of a unitary member with the elongated securing member, the anchoring member having a larger lateral dimension than the elongated securing member.

8. The crane of claim 7, wherein the pivoting arm comprises a distal end section, and wherein the crane further comprises a winch that is attachable to the distal end section of the pivoting arm.

9. The crane of claim 7, wherein the anchoring member is mechanically couplable to or comprises a unitary member with the elongated securing member to form a securing hook.

10. The crane of claim 7, wherein the anchoring member comprises a curved portion of a J-bolt and the elongated securing member comprises a generally linear portion of the J-bolt.

11. The crane of claim 7, wherein the elongated securing member further comprises a quick release assembly, the elongated securing member being securable to and releasable from the anchoring member employing the quick release assembly.

12. The crane of claim 7, wherein the elongated securing member defines a laterally positioned hole on a distal end portion of the elongated securing member for receiving a cotter pin, and the anchoring member comprises a planar member having an opening for receiving the elongated securing member.

13. A truck-mounted crane, comprising:

an elongated pole member having a first end section, a second end section, a midrange section, and a longitudinal axis, the second end section defining an aperture for receiving an elongated securing member, the elongated securing member having a threaded end;

a pivoting arm that is pivotally attachable to the first end section of the elongated pole member, the pivoting arm comprising a distal end section;

a support member secured to the midrange section of the elongated pole member, the support member comprising a longitudinal axis, a first plane-shaped member extending away from the pole member, and a second plane-shaped member secured to and abutting the elongated pole member, the first plane-shaped member being disposed in a generally perpendicular configuration relative to the second plane-shaped member, the longitudinal axis of the support member being generally perpendicular to the longitudinal axis of the elongated pole member;

an extension member being secured to the first plane-shaped member and having an axis of extension in a direction away from the first plane-shaped member, the axis of extension of the extension member being generally parallel to the longitudinal axis of the elongated pole member and generally perpendicular to the first plane-shaped member, the extension member and the first and second plane-shaped members defining an intervening space, the extension member comprising at least three planar members arranged in a generally rectangular hexahedron configuration with at least two open sides;

an anchoring plate defining a threaded opening for receiving and being secured to the threaded end of the elongated securing member, when the elongated securing member is positioned within the aperture; and a winch that is attachable to the distal end section of the pivoting arm.

14. A method securing the crane of claim 13 to a truck, the method comprising:

positioning the extension member within a socket of a truck bed rim of the truck such that the support member abuts the truck bed rim;

sliding the threaded end of the elongated securing member through the aperture defined by the second end section of the elongated pole member and through an open area of a truck bed cargo loop of the truck; and securing the threaded end of the elongated securing member to the threaded opening in the anchoring plate such that the truck bed cargo loop is secured between the second end section of the elongated pole member and the anchoring plate.

15. A method of removing the crane of claim 13 from a truck, the crane being previously secured to the truck, the method comprising:

unsecuring the threaded end of the elongated securing member from the threaded opening in the anchoring plate;

removing the threaded end of the elongated securing member from an open area of a truck bed cargo loop; and removing the extension member from a socket of a truck bed rim of the truck such that the support member no longer abuts the truck bed rim.

16. The crane of claim 13, wherein the elongated securing member comprises a second end opposite the threaded end having a longitudinal axis and at least one planar member secured to the second end, the planar member having a longitudinal axis that is disposed generally perpendicular to the longitudinal axis of the elongated securing member.

* * * * *